US007331581B2

(12) United States Patent
Xu et al.

(10) Patent No.: US 7,331,581 B2
(45) Date of Patent: Feb. 19, 2008

(54) INFLATABLE PACKERS

(75) Inventors: Zheng Rong Xu, Sugar Land, TX (US); Frank Espinosa, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 271 days.

(21) Appl. No.: 11/093,390

(22) Filed: Mar. 30, 2005

(65) Prior Publication Data

US 2006/0219400 A1 Oct. 5, 2006

(51) Int. Cl.
*E21B 33/127* (2006.01)

(52) U.S. Cl. ..... 277/334; 277/331; 166/187; 166/196

(58) Field of Classification Search ..... 277/331, 277/334, 341; 166/187, 196
See application file for complete search history.

(56) References Cited

U.S. PATENT DOCUMENTS 2,336,090 A 12/1943 Granger
2,723,721 A 11/1955 Corsette
2,778,432 A * 1/1957 Allen ..... 277/334
3,028,915 A * 4/1962 Jennings ..... 166/277
3,346,267 A 10/1967 Farley
3,398,655 A 8/1968 Waldrop
3,604,732 A * 9/1971 Malone ..... 285/106
4,317,407 A 3/1982 Blackwell (Continued)

FOREIGN PATENT DOCUMENTS

GB 2034372 6/1980

(Continued)

OTHER PUBLICATIONS

Super-Tough Carbon-Nanotube Fibers—A.B. Dalton et al., Nature vol. 423, Jun. 12, 2003, p. 703.

(Continued)

*Primary Examiner*—Alison K Pickard
(74) *Attorney, Agent, or Firm*—David Cate; Tim Curington; Robin Nava

(57) ABSTRACT

Improved inflatable packers are provided. A packer may be constructed from hybrid structures including slat structures and weave structures. A packer may include a bladder and a cover, with a plurality of slats disposed therebetween, and/or a weave structure or anti-extrusion layer disposed therebetween. The slats may vary in width and thickness, and be provided with a plurality of reinforcement members. The reinforcement members may be longitudinally and/or transversely disposed in the slats. One or more of the various components of the packer preferably include a fiber, a wire, a cable, a nanofiber, a nanotube, and/or a nanoparticle modified elastomer. Anchors may be attached to or embedded in the outer cover. The packer may include a carcass having an end coupling including a plurality of slats. Improved packer cups are also disclosed, and preferably include a body member reinforced with a nanotube or similar material.

5 Claims, 7 Drawing Sheets

U.S. PATENT DOCUMENTS

| | | | | | |
|---|---|---|---|---|---|
| 4,349,204 | A | * | 9/1982 | Malone | 277/334 |
| 4,424,861 | A | * | 1/1984 | Carter et al. | 277/334 |
| 4,892,144 | A | * | 1/1990 | Coone | 277/334 |
| 4,923,007 | A | | 5/1990 | Sanford | |
| 5,327,962 | A | * | 7/1994 | Head | 277/334 |
| 5,340,626 | A | * | 8/1994 | Head | 277/334 |
| 5,469,919 | A | * | 11/1995 | Carisella | 166/387 |
| 5,507,341 | A | * | 4/1996 | Eslinger et al. | 166/187 |
| 5,613,555 | A | * | 3/1997 | Sorem et al. | 166/187 |
| 5,695,008 | A | * | 12/1997 | Bertet et al. | 166/187 |
| 6,318,482 | B1 | * | 11/2001 | Fidtje | 175/318 |
| 6,402,120 | B1 | | 6/2002 | Swaab | 249/117 |
| 6,431,275 | B1 | * | 8/2002 | Turley | 166/187 |
| 6,595,283 | B1 | * | 7/2003 | Turley et al. | 166/195 |
| 2003/0037932 | A1 | | 2/2003 | Guillory et al. | |
| 2004/0216871 | A1 | | 11/2004 | Mendez et al. | |
| 2005/0109502 | A1 | * | 5/2005 | Buc Slay et al. | 166/179 |

FOREIGN PATENT DOCUMENTS

| | | |
|---|---|---|
| GB | 2382364 | 5/2003 |
| WO | 01/06087 | 1/2001 |

OTHER PUBLICATIONS

Arrigoni S et al; "Tecnoflon fluroelastomers and perfluoroelastomers: the right choice for oilfield applications" Oilfield Engineering With Polymers Conference, Nov. 3, 2003.

* cited by examiner

INFLATABLE PACKERS

BACKGROUND OF THE INVENTION

1. Field of the Invention

The present invention generally pertains to downhole oilfield equipment, and more particularly to improved inflatable packers.

2. Description of the Related Art

It is known that there are mainly two kinds of inflatable packers, namely, slat type and weave or cable type. The slat type inflatable packers usually have a high pressure rating and a large expansion ratio. However, in general the slat type inflatable packers are not recommended for open hole applications, especially with a high expansion, because the slats do not have enough flexibility to conform to open hole profiles with potential irregularities. As a result, the inner tube or bladder of the slat type packer may be extruded through the openings between the slats. On the other hand, weave type structures will equip the packer element with enough compliance to conform to the well bore geometry, but they have a low pressure rating and a small expansion ratio. In addition to the structural design of an inflatable packer, the mechanical performance and reliability of inflatable packers depend in part upon the mechanical properties of the materials used.

As will become apparent from the following description and discussion, the present invention overcomes the deficiencies of the previous packers and constitutes an improved packer. In one aspect of the present invention, this is accomplished by the development of hybrid structures for through-tubing multiple-settable high-expandable inflatable packer elements which utilize unique features of slat type and weave type structures to achieve a much improved performance and compliance of the packer elements in open hole environments as well as cased hole environments. In another aspect of the present invention, improvement in the field of packers may be achieved by development of inflatable packer elements with high expansion ratios, high pressure ratings, high extrusion resistance, and good shape recovery after deflation by the use of materials from the fields of fiber reinforced composites and nanotechnology, including, for example, various fiber reinforced elastomers, polymers, and/or metals, and nanofiber, nanotubes, nanoparticle modified elastomers, polymers and/or metals. Details concerning these types of materials can be found, for example, in WO0106087, U.S. Pat. No. 6,102,120, and A. B. Dalton et al., Super-Tough Carbon—Nanotube Fibres, Nature, Vol. 423, 12 Jun. 2003, p. 703 ("Dalton"). The authors in Dalton outline their process of synthesizing single-walled nanotube (SWNT) fibers into 100 meter length bundles. These fibers can then be formed into a mesh or woven into other fibers as a rubber reinforcement. Nanotechnology materials exhibit superior properties over traditional materials, including greater strength, flexibility, elongation and compliance to irregular surfaces such as those found in open hole applications.

SUMMARY OF THE INVENTION

An embodiment of the present invention comprises an inflatable packer having an inflatable element having a plurality of slats disposed at its ends and a weave type structure disposed between the plurality of slats.

Another embodiment of the present invention comprises an inflatable packer having a bladder, a cover comprising a weave type structure, and a plurality of slats disposed between the bladder and the cover.

Yet another embodiment of the present invention provides an inflatable packer comprising a bladder constructed from a soft rubber, a plurality of slats disposed about the bladder, a weave type structure disposed about the slats and constructed from a soft rubber, and a cover disposed about the weave structure and constructed from a hard rubber.

Yet another embodiment of the present invention provides an inflatable packer comprising a bladder having at least one of a nanofiber and a nanoparticle modified elastomer, a carcass having an end coupling and a plurality of slats disposed about the bladder, and a cover seal having at least one of a fiber, a nanofiber, a nanotube and a nanoparticle modified elastomer.

Still another embodiment of the present invention provides a slat for use in an inflatable packer comprising a body member having a length, a width and a thickness, and having a plurality of reinforcement members disposed in the body member and comprising at least one of a wire, a cable, a fiber, a nanofiber, a nanotube, a nanoparticle modified elastomer and a high strength metal.

Another embodiment of the present invention provides an inflatable packer comprising an end coupling, a main body section, and a transition section therebetween that comprises reinforcement members disposed at different angles.

Another embodiment of the present invention provides a packer cup having a body member, a support member, and a plurality of reinforcement members disposed in the body member.

Other features, aspects and advantages of the present invention will become apparent from the following discussion.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
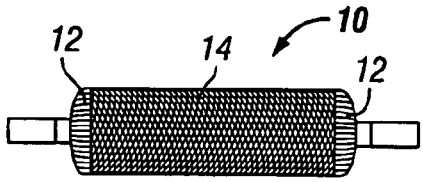
FIG. 1 is a side view of a specific embodiment of a packer constructed in accordance with the present invention.

Referring to the drawings in detail, wherein like numerals denote identical elements throughout the several views, there is shown in FIG. 1 a schematic of a "hybrid" structure for an inflatable packer element 10 having slat type structures 12 at both ends and a weave type structure 14 disposed therebetween. It is well known that an inflatable packer element is more vulnerable to rupture in the inflation stage than afterwards. And it is also known that the most vulnerable place in the element to failure is its transition area. Using slat type structures 12 at these areas will supply an excellent anti-extrusion layer to reduce vulnerability to rupture in these areas. The weave type structure 14 functions to make the element 10 compliant enough to conform to the shape of the wellbore.

Figure 2:
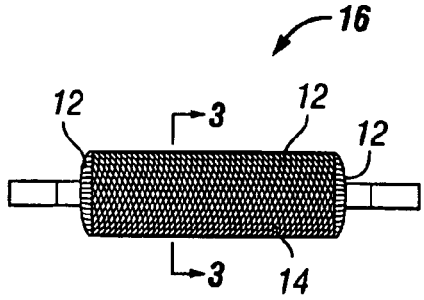
FIG. 2 is a side view of another specific embodiment of a packer constructed in accordance with the present invention.
Figure 3:
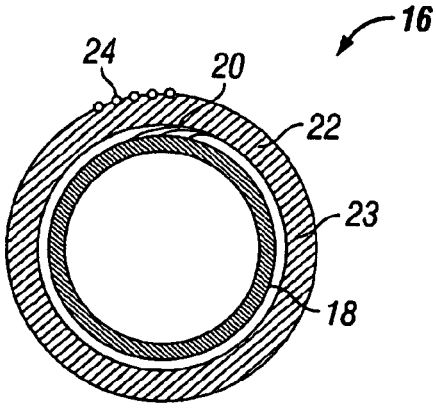
FIG. 3 is a cross-sectional view taken along lines 3-3 of FIG. 2.

In another specific embodiment of the present invention, another "hybrid" structure for an inflatable packer element 16 is shown in FIG. 2, in which slats may be placed throughout the length of the packer element 16, while the packer 16 is fully covered with a weave type structure(s) 14. This aspect of the present invention is further illustrated in FIG. 3, which is a cross-sectional view of the "hybrid" type structure shown in FIG. 2. As shown in FIG. 3, in a specific embodiment, the packer element 16 may include a bladder 18, one or more slats 20, a weave-type cover 22 and a plurality of anchors 24. The bladder 18 may be constructed from an elastomeric material in the form of a hollow cylinder to hold inflation fluids. The bladder 18 may be designed to have anisotropic properties in order to control its expansion behavior and/or process. The slats 20 preferably serve at least two functions. One function may be to form an anti-extrusion barrier and the other may be to carry the mechanical load. The slats 20 can be made from high strength alloys, fiber reinforced materials including fiber-reinforced elastomers, nanofiber and/or nanotube reinforced elastomers, or other advanced materials. The slats 20 will preferably have their maximum strength in their length direction, and will be as thin as the design permits to give enough room for the cover. The cover 22 is preferably made of weave type structures, and is preferably constructed from an elastomeric material with embedded reinforcement members 23. These reinforcements 23 may be embedded in certain patterns to facilitate and control its expansion. For example, the reinforcements 23 can be placed in the packer axial direction to minimize any length changes during inflation and potential rubber tearing problem. The cover 22 will preferably be as thick as the design permits to supply enough compliance to conform to possible irregularities in open hole environments. In a specific embodiment, the anchors 24 may be partially exposed cables and function to provide more friction between the packer element 10/16 and the wellbore.

In order to have enough conformity to fit it into possible irregular open hole profiles, the packer element 10/16 will preferably be provided with a certain degree of flexibility. Because the bladder 18 and cover 22 should have a good compliance to the well bore, the slat design can be quite important to achieve this purpose. In a specific embodiment, the slats 20 can be designed to be very thin in order to reduce its stiffness. In another specific embodiment, the slats 20 may also be made from "flexible" composite materials. The reinforcements (see item 25 in FIG. 4, discussed below) may be placed in the axial direction to carry the mechanical load, and the matrix can be made from materials with very low flexural modulus that is close to that of the rubbers used to make the bladder 18. With tailored designs, a slat 20 made from flexible composite materials can have a much lower stiffness than one made from metallic materials. The fiber materials used to construct the various components of the elements 10/16 may be carbon fibers, glass fibers, aramid fibers, ceramic fibers, metallic fibers, synthetic fibers, and/or their nanofibers, nanotubes, nanoparticles, and may also include other conventional materials. The fiber materials may be embedded in a format of a single fiber or a bundle of fibers (cords). The matrices in the slat may be constructed from rubbers, melt processible rubbers, thermoplastics, thermoplastic elastomers, and/or other materials having similar properties.

Figure 4:
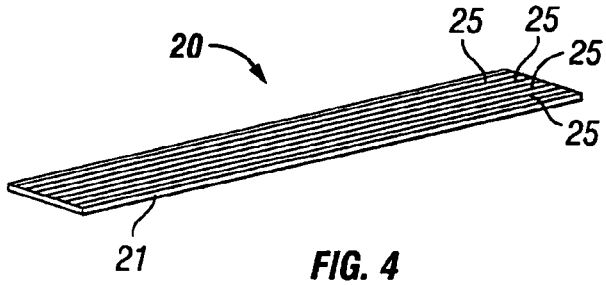
FIG. 4 is a perspective view of a specific embodiment of a slat for use in a packer constructed in accordance with the present invention.

A specific embodiment of a design for a flexible slat 20 is shown in FIG. 4. In this embodiment, all of the reinforcements 25 are placed in the longitudinal direction, and thus the stiffness of the slats 20 in the transverse direction will be dominated by the stiffness of the matrix or slat body member 21, which is a very flexible material made from any suitable material, such as rubber. The longitudinal stiffness of the slat 20 in this specific embodiment will preferably be a portion of that of a metallic slat.

Figure 5:
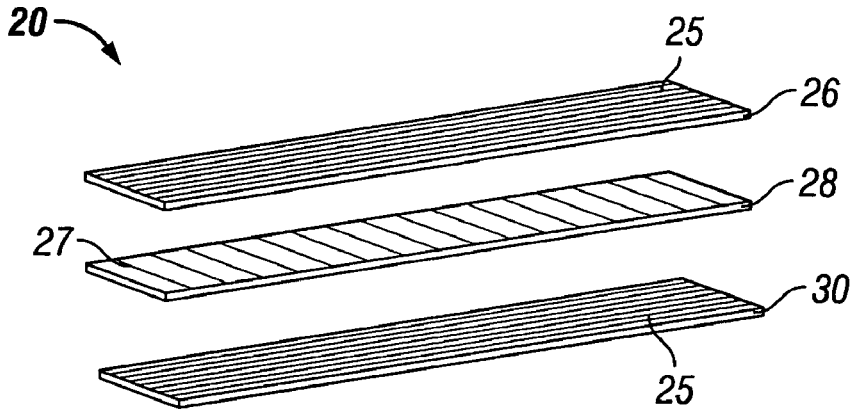
FIG. 5 is a perspective view of another specific embodiment of a slat for use in a packer constructed in accordance with the present invention.

Another specific embodiment of a slat 20 is shown in FIG. 5, in which most of the reinforcements 25 are placed in the axial direction, and a small portion of the reinforcements 27 will be placed in the transverse direction. As shown in FIG. 5, the slat 20 includes a first reinforcing sheet 26, a second reinforcing sheet 28, and a third reinforcing sheet 30. The first and third sheets 26, 30 may be slats of the type shown in FIG. 4 (i.e., with the reinforcements 25 disposed lengthwise along a longitudinal axis of the sheet 26). The first and third sheets 26, 30 are shown with the second sheet 28 disposed therebetween. The second sheet 28 may be provided with its reinforcements 27 in a transverse direction (i.e., generally at right angles to the longitudinal reinforcements 25 in the first and third slats 26, 30). This design will provide the slat 20 with an increased strength in the transverse direction.

Figure 6:
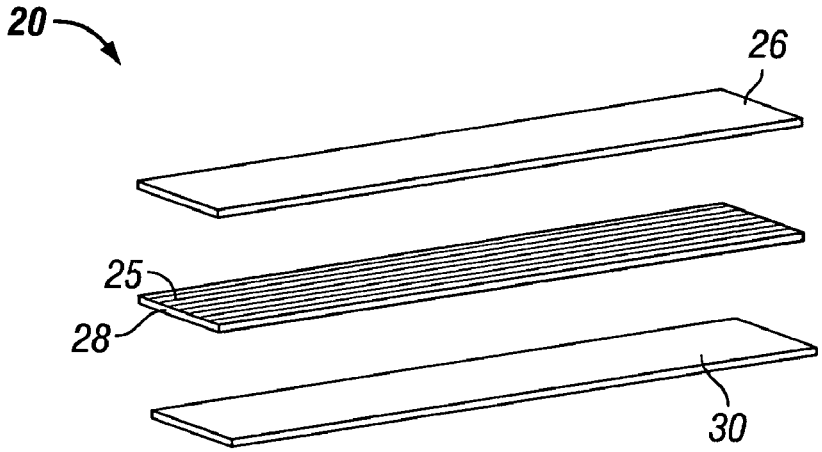
FIG. 6 is a perspective view of another specific embodiment of a slat for use in a packer constructed in accordance with the present invention.

Another specific embodiment of a slat 20 is shown in FIG. 6. In this embodiment, a slat type sheet 28 having reinforcements 25 disposed lengthwise along the longitudinal axis of the sheet 28 is disposed between films 26, 30 comprising matrix materials with very low flexural modulus that is close to that of the rubbers used to make the bladder. This design will provide the slat 20 with an increased strength in the transverse direction.

Figure 7:
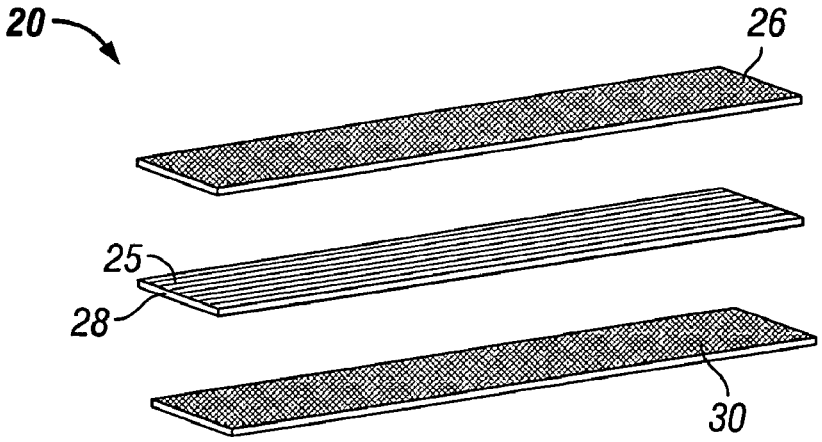
FIG. 7 is a perspective view of another specific embodiment of a slat for use in a packer constructed in accordance with the present invention.

Yet another specific embodiment of a slat 20 is shown in FIG. 7. In this embodiment, a slat type sheet 28 having reinforcements 25 disposed lengthwise along the longitudinal axis of the sheet 28 is disposed between fibrous mats 26, 30 comprising matrix materials with very low flexural modulus that is close to that of the rubbers used to make the bladder. The matrix materials of the fibrous mats 26, 30 provide randomly distributed reinforcements. This design will provide the slat 20 with an increased strength in the transverse direction.

Figure 8:
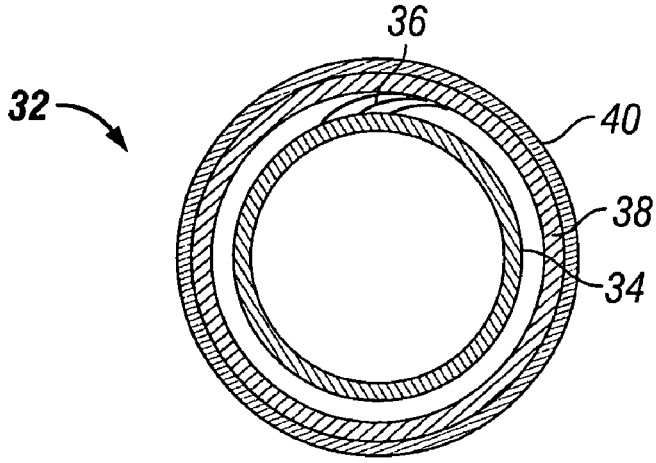
FIG. 8 is a cross sectional view of another specific embodiment of a packer element constructed in accordance with the present invention, and including a hybrid rubber structure.

Another approach to prevent rubber tearing, as shown in FIG. 8, is to provide a hybrid rubber structure to adapt to different requirements on the rubbers during its expansion. In the specific embodiment shown in FIG. 8, the packer element 32 may comprise a bladder 34 constructed from a soft rubber, slats 36, a weave type structure 38 constructed from a soft rubber, and an outer cover 40 constructed from a hard rubber. "Soft" rubber refers to a rubber that is capable of being highly elongated or sheared. "Hard" rubber refers to a rubber that has high rebound resilience and low compression and tensile set. The use of soft rubber is advantageous since the bladder 34 experiences high elongation, and since high shear strains are developed in the weave type structure layer 38. The "hard" rubber is employed in the outer cover 40 to assist in the retraction of its shape after the packer 32 is released.

Figure 9:
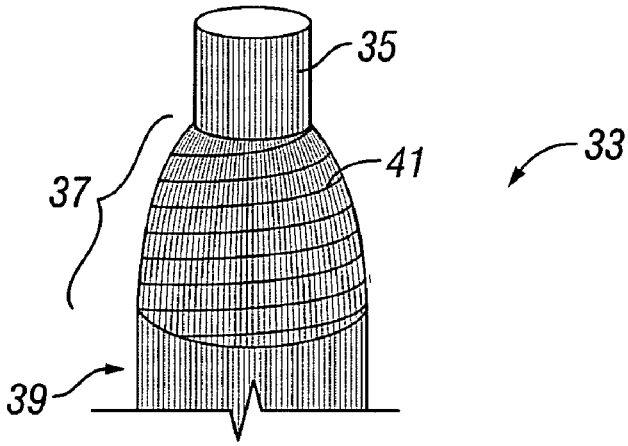
FIG. 9 is a perspective view of the end of a packer element constructed in accordance with the present invention.

As shown in FIG. 9, a specific embodiment of a packer 33 may include an end coupling 35 and a transition section 37 extending from the end coupling 35 to a main body section 39. The shape of the transition section 37 where the packer 33 is expanded from its collapsed state to a full expansion can be controlled by a fit-to-purpose design where the fiber angles and/or fiber patterns are arranged so that the maximum radial expansion varies along its length. For example, the transition section 37 may include a reinforcement member 41 disposed in different angles relative to the axial direction.

Figure 10A:
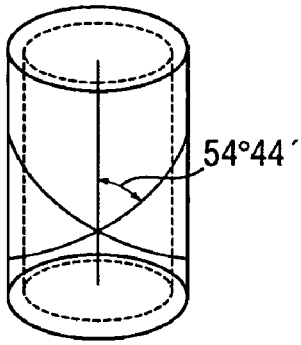
FIG. 10 illustrates exemplary rotation of the fibers or cords in a weave type packer element when expanding.
Figure 10B:
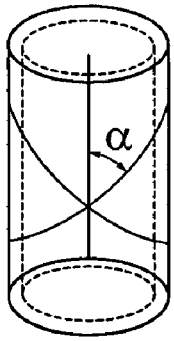
Figure 10C:
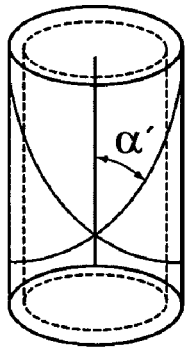

As illustrated in FIG. 10, there is a fixed or critical fiber angle for a fiber-woven cylinder with closed ends during expansion under internal pressure. The calculation of composite mechanics shows the angle is 54°44' relative to the axial direction, see FIG. 10*a*. During expansion, the fibers are rotating. When the fibers rotate to the critical angle, the fibers will not rotate any more, and thus the cylinder will not expand. By placing fibers at different initial angles along the axial direction in the transition section, the shape of the transition section can be controlled. The smaller the initial fiber angle, the more the cylinder can expand. For example, the initial fiber angle, $\alpha$, in FIG. 10*b* is larger than the angle, $\alpha'$, in FIG. 10*c*, and thus the cylinder in FIG. 10*b* will expand less than the one in FIG. 10*c*.

Figure 11:
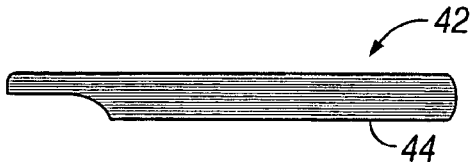
FIG. 11 is a side view of a tapered slat constructed in accordance with the present invention, and having longitudinal reinforcements disposed therein.

Another aspect of the present invention relates to an improved carcass structure for use in inflatable packers, and may be particularly useful in applications where the packer requires a high expansion and high pressure rating. In a specific embodiment, as shown in FIG. 11, this aspect of the present invention may be constructed with tapered slats 42. The slats 42 may be provided with reinforcements 44 embedded in a longitudinal direction. The slats 42 may also be provided with reinforcements embedded in the transverse direction as well if required (not shown). In a specific embodiment, the tapered slats 42 may be made from composite materials, in which the reinforcements 44 may be fibers, wires, cables, nanotubes, nanofibers, or nanoparticles, and the matrix can be elastomers, thermoplastic elastomers, elastoplastics, or other polymers. The composite slats 42 should be flexible enough to conform to an open hole bore profile and yet strong enough to carry the axial load generated by packer pressure.

Figure 12:
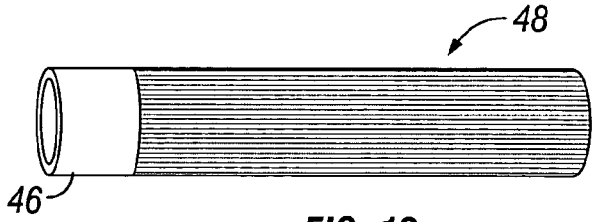
FIG. 12 is a perspective view of a packer carcass that includes tapered slats of the type shown in FIG. 11.

As shown in FIG. 12, in a specific embodiment, the tapered slats 42 may be manufactured together with an end coupling 46 to form a single-piece packer carcass structure 48. The coupling 46 may be used to attach other components of an inflatable packer element and to transfer the load to other load carrying components, as described elsewhere herein. In one embodiment, the reinforcements 44 in the slats 42 may be continuously extended into the end coupling 46, thereby facilitating load transfer from the slats 42 to the end coupling 46. The end coupling 46 may be made from high strength composite materials using the same reinforcements 44 as the slats 42. The matrix material in the end coupling 46 may be different from the material used in the slats 42 because its flexibility is not required. However, its manufacturing is preferably close to or the same as the slats 42. The end coupling 46 may be of different shapes to effectively transfer the load from the end coupling 46 to other load carrying components in the packer.

As mentioned above, another aspect of the present invention relates to the mechanical properties of the materials used to make the packer, which will impact the mechanical performance of the packer. It is believed that nanotechnology supplies some materials with superior properties over traditional materials. For example, it has been discovered that nanofiber and/or nanoparticle modified elastomers will provide inflatable packers with the components of high strength and high elongation. In one aspect, the present invention may include an inflatable packer element that has a high expansion ratio, high pressure rating, high extrusion resistance, and good shape recovery after deflation that is achieved by using nanofiber and/or nanoparticle modified elastomers and/or metals.

As will be described in more detail below, this aspect of the present invention is directed to an inflatable packer element that employs fiber, nanofiber, and/or nanoparticle modified elastomers for the bladder, anti-extrusion layer, carcass, and/or cover seal. The nanofibers and/or nanoparticles in the elastomeric bladder may be placed such that the bladder has a high elasticity, elongation, and tear resistance; the fibers, nanofibers, and/or nanoparticles in the elastomeric carcass, elastomeric slats, or metallic slats, may be placed such that the carcass has a high elasticity and tensile strength along its axial direction; and the fibers, nanofibers, and/or nanoparticles in the elastomeric cover may be placed such that the elastomeric cover seal has a high elongation, resilience, and tear and wear resistance. The placements of fibers, nanofibers, and/or nanoparticles may also be designed such that the packer shape after inflation can be controlled to optimize its mechanical performance and facilitate retraction after deflation to allow repeated usage of the packer element. The thickness and width of the slats of the carcass may vary within the same one or from one to another to optimize the deployment and mechanical performance of the packer. To further prevent the bladder from ripping, tearing, or extruding, fiber and/or nanofiber weaves may be placed between the bladder and carcass. The individual thickness of the bladder, anti-extrusion layer, carcass, and cover seal can be designed for different downhole environments.

Figure 13:
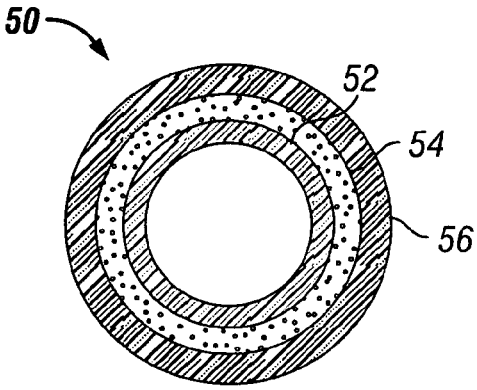
FIG. 13 is a cross-sectional view of a packer element constructed in accordance with the present invention.

Referring now to FIG. 13, a specific embodiment of an inflatable packer element 50 may include a bladder 52, a carcass 54 and a cover seal 56. In this specific embodiment, the bladder 52 may be constructed from a nanofiber and/or nanoparticle modified elastomeric material; the carcass 54 may be constructed from a fiber, nanofiber, and/or nanoparticle modified elastomeric material; and the cover seal 56 may be constructed from a fiber, nanofiber, nanotube, and/or nanoparticle modified elastomeric material.

Figure 14:
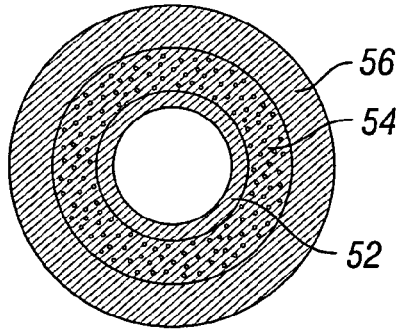
FIG. 14 is a cross-sectional view of a packer element constructed in accordance with the present invention.

Another specific embodiment of a packer element is shown in FIG. 14. In this embodiment, the bladder 52 (or inner rubber tube), the carcass 54, and the outer rubber sleeve 56, are made from the same material. However, the carcass 54 is reinforced with cords, wires, fibers, nanofibers, nanotubes, and/or nanoparticles.

Figure 15:
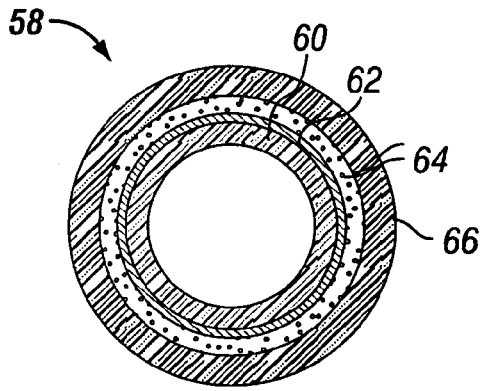
FIG. 15 is a cross-sectional view of another packer element constructed in accordance with the present invention.

Another specific embodiment of a packer element 58 is shown in FIG. 15. In this embodiment, the packer element 58 may include a bladder 60, an anti-extrusion layer 62, a carcass 64 and a cover seal 66. In this specific embodiment, the bladder 60 may be constructed from a nanofiber and/or nanoparticle modified elastomeric material; the anti-extrusion layer 62 may be constructed from a woven fiber and/or nanofiber material; the carcass 64 may be constructed from a fiber, nanofiber, and/or nanoparticle modified elastomeric material; and the cover seal 66 may be constructed from a fiber, nanofiber, and/or nanoparticle modified elastomeric material.

Figure 16:
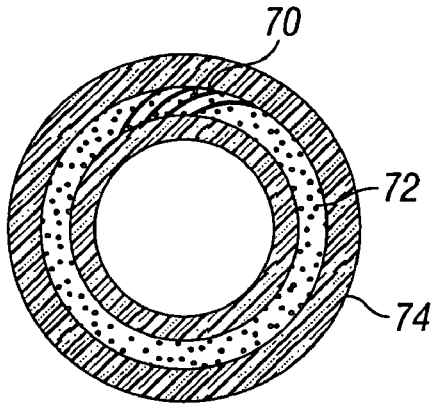
FIG. 16 is a cross-sectional view of another packer element constructed in accordance with the present invention.

Another specific embodiment of a packer element 68 is shown in FIG. 16, in which the packer element 68 may include a bladder 70, a plurality of slats 72, and a cover seal 74. In this specific embodiment, the bladder 70 may be constructed from a nanofiber and/or nanoparticle modified elastomeric material; the slats 72 may be constructed from fiber, nanofiber, and/or nanoparticle modified elastomeric materials, or from high strength metallic materials; and the cover seal 74 may be constructed from a fiber, nanofiber, and/or nanoparticle modified elastomeric material.

Figure 17:
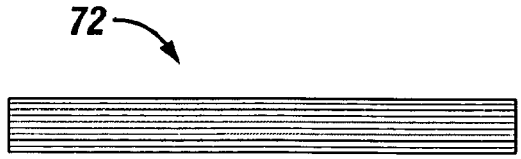
FIG. 17 is a side view of a slat constructed in accordance with the present invention.
Figure 18:
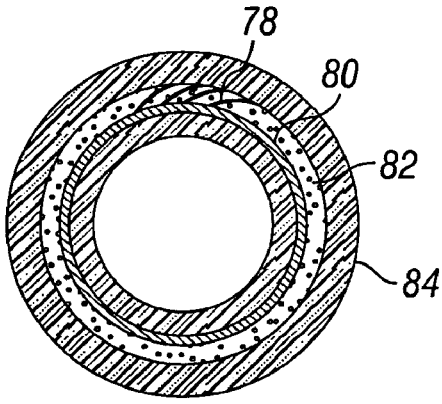
FIG. 18 is a cross-sectional view of another packer element constructed in accordance with the present invention.

Another specific embodiment of a packer element 76 is shown in FIG. 18, in which the packer element 76 may include a bladder 78, an anti-extrusion layer 80, a plurality of slats 82, and a cover seal 84. In this specific embodiment, the bladder 78 may be constructed from nanofiber and/or nanoparticle modified elastomeric materials; the anti-extrusion layer 80 may be constructed from a woven fiber and/or nanofiber material; the slats 82 may be constructed from fiber, nanofiber and/or nanoparticle modified elastomeric materials or from high strength metallic materials, such as the slats 72 shown in FIG. 17; and the cover seal 84 may be constructed from fiber, nanofiber, and/or nanoparticle modified elastomeric materials.

Figure 19:
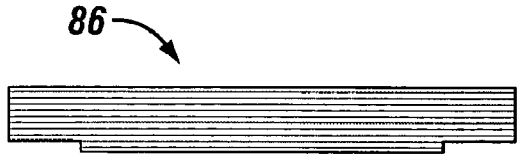
FIG. 19 is a side view of another slat constructed in accordance with the present invention.
Figure 20:
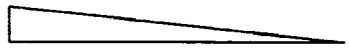
FIG. 20 is a side view showing a slat having a triangular cross section constructed in accordance with the present invention.
Figure 22:
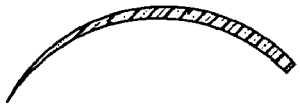
FIG. 22 is a side view showing a slat having a curved cross section constructed in accordance with the present invention.
Figure 21:
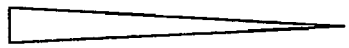
FIG. 21 is a side view similar to FIG. 20 and showing another slat having a triangular cross section constructed in accordance with the present invention.

In a specific embodiment, as shown in FIG. 19, the present invention may include a slat 86 having a width that may vary along its length. In this manner, the degree of overlap between adjoining slats may be maximized after inflation of the packer. In other embodiments, as shown in FIGS. 20-22, the slats may be provided with a triangular cross section (see FIGS. 20 and 21) or with a curved cross section (FIG. 22). These cross sections may assist in controlling the deployment of the slats.

Figure 23A:
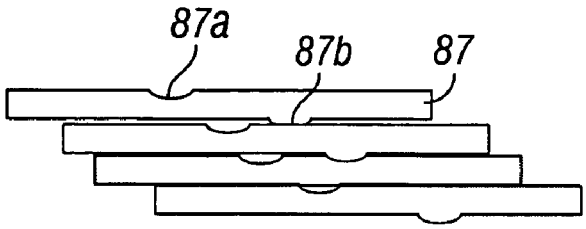
FIG. 23 is a side view showing a slat having a key-lock feature constructed in accordance with the present invention.
Figure 23B:
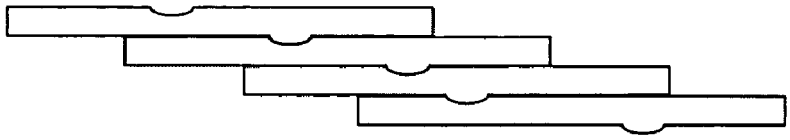

FIG. 23 illustrates an exemplary embodiment in which the deployment of the slats 87 is controlled. In the embodiment illustrated in FIG. 23, each of the adjoining slats 87 has one or more notches (or grooves) 87*a* and one or more keys (or protrusions) 87*b*. The notches 87*a* and keys 87*b* of the adjoining slats 87 interact to control the amount of expansion. As shown in FIG. 23*a*, prior to expansion of the packer element, the slats 87 are able to move in relation to each other. Upon expansion of the packer element, the slats 87 are eventually restricted from further movement when the interaction between the notches 87*a* and keys 87*b* locks the relative movement as shown in FIG. 23*b*.

Figure 24A:
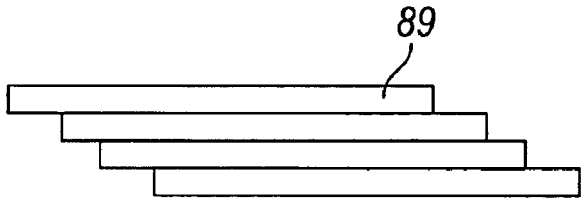
FIG. 24 is a side view showing a slat having a friction coefficient gradient along its transverse direction constructed in accordance with the present invention.
Figure 24B:
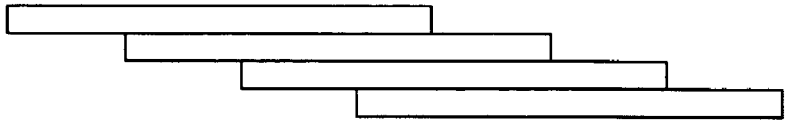

FIG. 24 illustrates another exemplary embodiment in which the deployment of the slats 89 is controlled. In the embodiment illustrated in FIG. 24, each of the adjoining slats 89 are constructed such that they have a friction coefficient gradient whereby the friction coefficient increases along the slats 89 transverse direction. As shown in FIG. 24*a*, prior to expansion of the packer element, the slats 89 are able to move in relation to each other with minimal frictional resistance. Upon expansion of the packer element, the slats 89 are eventually restricted from further movement by the frictional resistance between the adjoining slats 89.

Another aspect of the present invention relates to the use of materials from the field of nanotechnology in constructing packer cups. Packer cups are generally used to straddle a zone in a wellbore and divert treating fluid into the formation behind the casing. Packer cups are used because they are simple and a straddle tool that uses cup type elements does not require complex mechanisms or moving parts. Packer cups have slight nominal interference into the casing in which they are used. This interference is what creates a seal against the inner diameter of the casing and forces fluid to flow into a formation that is straddled by two or more packer cups. Packer cups must seal against extreme differential pressure. As such, packer cups have historically been constructed from strong and tear resistant rubber materials. Examples of materials that have been used in the past include nitrile, viton, hydrogenated nitrile, natural rubber, aflas, and urethane. A packer cup should be flexible in order to run into a well without becoming stuck and should also be strong and durable so that high differential pressure can be held without extrusion or rupture. A typical elastomer is less flexible when steps are taken to improve its tensile strength. For example, a more cross-linked nitrile rubber may have higher durometer hardness and tensile strength, but it is more likely to experience high friction forces and be damaged when the rubber must flex around an obstruction in a well bore. A material that possesses the flexibility of a soft nitrile rubber but has the tear strength and tensile strength of a much harder rubber would both improve the ease with which the cup may be transported into a well bore and also improve the capability of the cup to withstand high differential pressure.

Figure 25:
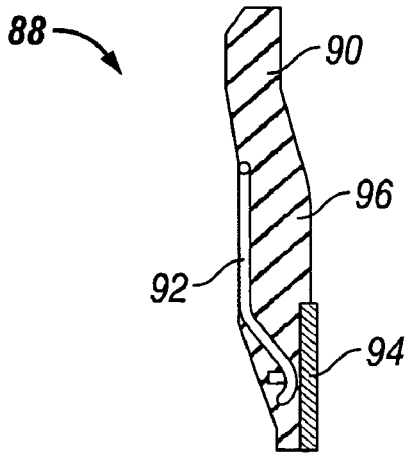
FIG. 25 is a side view in partial cross section showing a packer cup constructed in accordance with the present invention.
Figure 26:
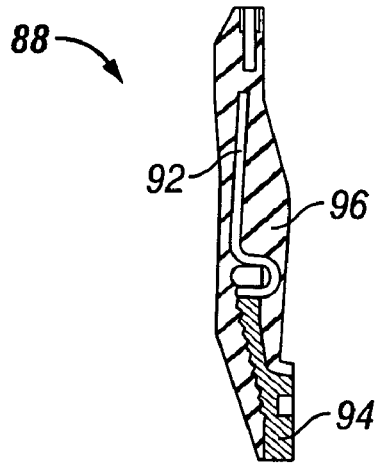
FIG. 26 is a side view in partial cross section showing another packer cup constructed in accordance with the present invention.
Figure 27:
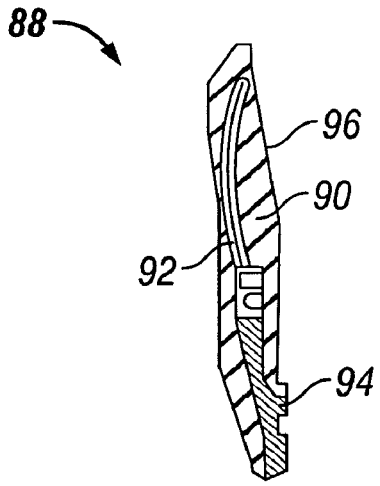
FIG. 27 is a side view in partial cross section showing another packer cup constructed in accordance with the present invention.
Figure 28:
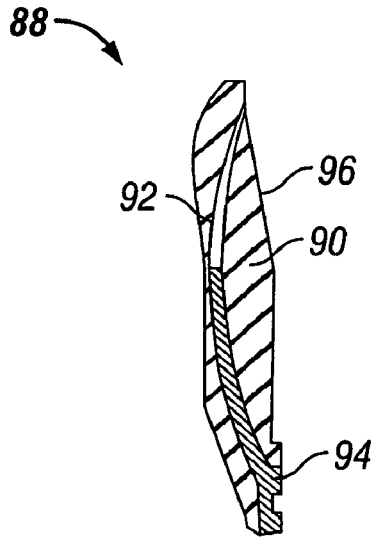
FIG. 28 is a side view in partial cross section showing another packer cup constructed in accordance with the present invention.

Each of FIGS. 25-28 illustrate a packer cup 88 constructed in accordance with the present invention. Each packer cup 88 includes a body member 90 and a support member 92 attached to a metal base 94. The support members 92 in the packer cups 88 shown in FIGS. 25-27 are wires, and the support member 92 in the packer cup 88 in FIG. 28 is a slat. The body members 90 may be constructed from rubber or other suitable materials, and are reinforced with reinforcement members 96, such as nanotubes or extremely small, high strength tubes that may be molded into the rubber or other body material. By incorporating reinforcement members 96 into the body member 90, tear strength of the rubber is improved and extrusion of the rubber when under high pressure is minimized.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. An inflatable packer comprising:

a bladder;

a cover comprising a weave type structure; and a plurality of slats disposed between the bladder and the cover, each slat being formed of a plurality of sheets having reinforcements, the reinforcements of at least two sheets being placed in different orientations, wherein the plurality of sheets are combined to form each unitary slat.

2. The inflatable packer of claim 1, wherein one or more slats comprise a plurality of reinforcement members made from at least one of the group consisting of high strength alloys, fiber reinforced polymers and/or elastomers, nanofiber, nanoparticle, and nanotube reinforced polymers and/or elastomers.

3. The inflatable packer of claim 2, wherein one or more slats comprise a first sheet, a second sheet and a third sheet, the second sheet being disposed between the first and third sheets.

4. The inflatable packer of claim 1, wherein the slats include at least one of a fiber, a nanofiber, a nanoparticle modified polymer and/or elastomer and a high strength metal.

5. The inflatable packer of claim 1, further including a anti-extrusion layer disposed between the bladder and the cover seal, and including at least one of a woven fiber, a nanofiber, a nanotube, and a nanoparticle.

* * * * *